United States Patent [19]

Avotins et al.

[11] Patent Number: 4,585,550

[45] Date of Patent: Apr. 29, 1986

[54] HIGH MOLECULAR WEIGHT CARBOXYLIC ACIDS AS COLLECTORS OF MINERAL VALUES FROM CARBONACEOUS ORES

[75] Inventors: Peter V. Avotins, Fairfield; Donald P. Spitzer, Riverside, both of Conn.

[73] Assignee: American Cyanamid Company, Stamford, Conn.

[21] Appl. No.: 647,772

[22] Filed: Sep. 6, 1984

[51] Int. Cl.[4] ..... B03D 1/02

[52] U.S. Cl. ..... 209/166; 252/61

[58] Field of Search ..... 209/3, 166, 167; 252/61

[56] References Cited

U.S. PATENT DOCUMENTS

| | | | |
|---|---|---|---|
| 2,130,574 | 9/1938 | Breerwood | 209/167 |
| 2,433,258 | 12/1947 | Booth et al. | 209/166 |
| 2,857,331 | 10/1958 | Hollingsworth | 209/167 |
| 4,196,092 | 4/1980 | Wang et al. | 252/61 |
| 4,406,664 | 9/1983 | Burgess et al. | 209/166 |
| 4,504,385 | 3/1985 | Keys | 252/61 |
| 4,511,461 | 4/1985 | Kruyer | 209/166 |

FOREIGN PATENT DOCUMENTS

| | | | |
|---|---|---|---|
| 542966 | 7/1957 | Canada | 252/61 |
| 0106787 | 4/1984 | European Pat. Off. | 252/61 |
| 135042 | 3/1960 | U.S.S.R. | 252/61 |

*Primary Examiner*—Bernard Nozick

*Attorney, Agent, or Firm*—Frank M. Van Riet

[57] ABSTRACT

A process for the recovery of mineral values from carbonaceous ores is disclosed wherein the collector comprises a hydrocarbon acid or acidester having a molecular weight of at least about 500, an oil, and optionally, a sulfonated hydrocarbon compound.

11 Claims, No Drawings

HIGH MOLECULAR WEIGHT CARBOXYLIC ACIDS AS COLLECTORS OF MINERAL VALUES FROM CARBONACEOUS ORES

BACKGROUND OF THE INVENTION

Many ores mined throughout the world contain economically significant concentrations of certain mineral values such as gold, silver, platinum, gallium, germanium, indium and the like. These mineral values may be present in an uncombined form or in combination with various other components of the ore such as coal. Many ores contain as little as 2% coal, the coal, however, containing high concentrations of the desired mineral values.

Standard methods of concentrating these coal fractions from ore, e.g. flotation, have not proven to be effective. Because the coal fraction of interest is usually dispersed throughout the mineral matrix of the ore, the coal is usually oxidized, and therefore conventional collectors such as fuel oil are ineffective. Other methods of concentration such as spirals or jigs have also failed to achieve satisfactory separations of the carbonaceous fraction.

The use of various acidic collectors for coal flotation are disclosed in published EPO Applications Nos. 0,106,787 (4/25/84) and 84/109310/18 while U.S. Pat. Nos. 4,253,944; 4,278,533; 4,305,815; 4,330,339 disclose acid reaction products for the same purpose. The materials are either expensive or difficult to produce and therefore a search for new, effective collectors continues.

Therefore, if a process could be devised whereby the coal, particularly if oxidized, is recoverable economically and effectively as a mineral value bearing fraction, from ore, a significant step forward in the art would be realized.

SUMMARY OF THE INVENTION

According to the present invention, a coal fraction containing economically significant concentrations of desirous mineral values is recovered from a carbonaceous ore containing the same in minor amounts by contacting the ore with a collector comprising an oil, an acid or acidester having a molecular weight of at least about 500, and, optionally, a sulfonated hydrocarbon compound. The process is particularly effective in the concentration of coals containing quantities of germanium.

DESCRIPTION OF THE INVENTION INCLUDING PREFERRED EMBODIMENTS

The process of the present invention comprises, (a) grinding a carbonaceous ore having, as a component thereof coal containing mineral values, to a particle size smaller than about 28 mesh, (b) diluting the resultant ground ore with water to thereby form a slurry having a solid concentration of from about 40–400 gm/l, (c) contacting the resultant slurry with a collector comprising an oil, an acid or acidester having a molecular weight of at least about 500 and, optionally, a sulfonated hydrocarbon compound for from about 0.1–30 minutes, with agitation, (d) adding a frother to the so-contacted slurry and (e) recovering the coal component of said ore by froth flotation.

Any oil may be used in the process of the present invention, as a component of the collector however, fuel oil is preferred. Other oils such as crystal free neutral oil recovered from coal tar, kerosene and the like may be used.

The acids or acidesters which may be used herein comprise those hydrophobic carboxylic acids and their acidesters known in the art having molecular weights of at least about 500. Crude mixtures of acids such as tall oil, palm oil, cottonseed oil, olive oil, linseed oil and the like commercially available as high molecular weight fractions from e.g. the Arizona Chemical Company under the tradename Actinol ®, and from the Hercules Chemical Company under the tradename Dymerex ® or PolyPale ® may be used.

If mixtures of these acids are used, the average molecular weight of these mixtures should be within the above designations. Other useful materials include dimers, trimers and polymers of unsaturated acids and/or rosin acids while fractions obtained by the fractionation of tall oil pitches, condensation products of long chain acids and polyols, tall oil pitches per se and the like, are preferred.

The preparation of the dimer, trimer and polymeric acids useful herein from fatty acids or acidesters is taught in the literature, e.g. J. C. Cowan; J. Am. Oil Chemists' Soc. 39, 534–545, 1962; E. C. Leonard, ibid, 56, 782A–785A, 1979. Commercial products are usually prepared by the process of clay catalyzed, high temperature polymerization. The final products consist of mostly 36 carbon atom entities i.e. dimers, although trimeric and polymeric acids are also produced. These products are oftimes fractionated into specific fractions to concentrate dimers, trimers etc.

The exact structure of the polymerized acids is not yet fully determined. However, a variety of suggestions have been proposed in the literature. One structure is essentially that of a long chain dicarboxylic acid with two alkyl side chains. It appears to contain at least one ethylenic bond and another "linkage" resulting from the polymerization of the two unsaturated fatty acid molecules that form dimer acid. Some idealized possible structures for dimer acids are shown below.

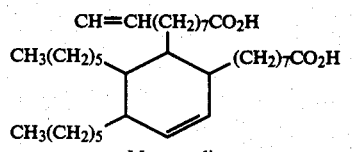

Monocyclic

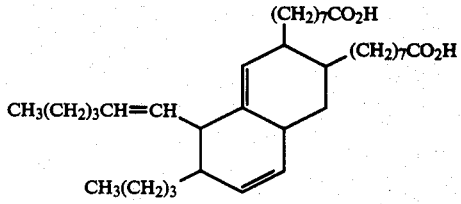

Bicyclic

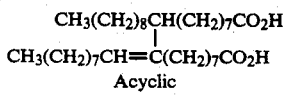

Acyclic

The molecular weight of these dimer acids is about 560.

"Pure" aliphatic trimer acid is a long-chain tricarboxylic acid formed by the linking of three unsaturated monobasic fatty acids. The structure is similar to that of dimer acid. The molecular weight of trimer acid is about 800. Polymeric acid is a polybasic acid with molecular weight usually higher than 800.

Besides the commercial process of polymerization, unsaturated fatty acid can be polymerized at 270°-370° C. under pressure with or without catalyst. (For example, C. G. Goebel, J. Am. Oil Chemist Soc., 24, 65-68 (1947). The structure of the product has been suggested to be similar to those aforementioned.

Other types of high molecular weight, hydrophobic carboxylic acid useful herein are the polymeric acids which are prepared by the polymerization of rosin acids. The two double-bond abietic-type rosin acids react through a Diels-Alder type mechanism to form dimers, trimers and polymers. Sulfuric acid, an alkyl or metal halide is generally used as the catalyst. The reaction is carried out at room temperature over an extended period of time. The molecular weight of a "pure" dimeric rosin acid is about 600.

Another method, besides the "synthesis process" described above, to obtain high molecular weight, hydrophobic carboxylic acids useful herein is the fractionation of tall oil pitch. Tall oil pitch is the non-distillable residue left during the fractional distillation of crude tall oil. The studies on the composition and fractionation of tall oil pitches obtained from different sources have revealed that these tall oil pitches contain large amounts of high molecular weight, hydrophobic carboxylic acid (V. Era and K. Noronen, J. Am. Oil Chemists Soc., 56, 992-994 (1979); and B. Holmbom, ibid, 55, 342-344 (1978). These tall oil pitches are mixtures with a broad distribution of molecular weights and contain high concentrations of substance whose molecular weight ranges from 550 to 9,000. For the fractionation of tall oil pitch, various techniques have been employed. These include solvent extraction and acid-base extraction.

As used herein, the term "acidester" means an ester which contains at least some functional carboxylic groups. Useful acidesters include those obtained by the reaction of a suitable alcohol such as isobutyl alcohol with polymers of, for example, maleic anhydride, such as maleic anhydride-octadecene-1 copolymers to produce the resultant half-ester. Alternatively, an acid anhydride e.g. tetralin dianhydride, may be reacted with alcohols such as stearyl alcohol resulting in the half stearyl ester of tetralin dianhydride.

An optional, but preferred, component which may be present in the collectors used in the process of the present invention comprise the sulfonated hydrocarbons. Suitable examples thereof include sulfonated aromatics such as sulfonated hexadecyl oxybenzene; sulfonated petroleum materials such as petroleum lignosulfonates and the like. These materials may be added in amounts ranging from about 1% to about 30%, by weight, preferably about 5-20%, based on the total weight of acid or acidester and oil.

The term "oxidized coal" has come to include any coal that is hydrophilic and poor floating, especially surface coals, or coals of naturally low grade. They are characterized by high oxygen content (i.e. many oxygen-containing functional groups) at least on the coal particle surface.

Activators, conditioning reagents, dispersing reagents, depressing reagents etc. may also be used in conjunction with the collectors employed in the present process.

Dosages of collector ranging from about 0.1 to about 10 lbs. per ton of ore may be used, preferably at least about 0.5 lb./ton. Overdosing is not harmful.

Solids levels of over 70 gm/l, preferably over 200 gm/l of the ore may be used in the flotation process, however these levels are not critical and higher or lower levels may oftimes be used.

Step (a) of the present invention, i.e. grinding the carbonaceous ore, is effected in order (1) to reduce the size of the ore to a size small enough for flotation i.e. smaller than about 28 mesh, (2) to liberate the coal from other matrix materials present (generally silica, clays, and other silicates) and (3) to expose fresh surfaces of coal.

Although −28 mesh is generally considered suitable size for flotation, the nature of the ore being ground may require grinding to smaller sizes e.g. −200 mesh, since flotation separation requires that the coal and matrix materials be present as distinct particles, separated from one another. However, even if the coal particles are already liberated in the charge ore, the external surfaces of the coal particles will be the most oxidized areas, thereby making the coal particles difficult to float. Although the interior of the coal particles may also be quite oxidized, they are generally less oxidized than the external surface. Consequently, grinding the coal particles to size is considered to be an essential step in the instant process. Grinding may be accomplished by any method known for mineral processing such as rod mills, ball mills, attrition mills and the like.

Dilution of the ground ore by the addition of water thereto is then carried out. A solids concentration in the range of about 40-400 gm/l, preferably about 100-300 gm/l is required.

Oftimes, at this point in the process, desliming i.e. removal of particles of less than about 400-500 mesh, is required. This procedure results, when necessary, in an overall more complete recovery of the coal is, in fact, preferred. Desliming may be accomplished by any acceptable and known procedure, such as by the use of hydrocyclones or thickeners.

Contact of the slurry with the collector used in accordance with the present invention is preferably accomplished after the pH of the slurry is adjusted to about 5.0-8.0. Of course, if the natural pH of the slurry falls within this range, no adjustment is necessary.

When the collector is added to the slurry, mixing for from about 0.1 to about 30 minutes, preferably from about 1 to about 10 minutes, is conducted in order to ensure contact between droplets of the collector and the particles to be floated. The conditioning time depends upon many variables including the collector composition and concentration, the degree of oxidation of the coal and the solids concentration. The conditioning may be accomplished in the flotation cell or is a separate mixing vessel.

Frother is then added and the ore is floated in an appropriate flotation cell. The coal is concentrated in the froth, skimmed off and sent to a filtration recovery one. All non-floating particles are transferred to a thickener (along with fines from the desliming step, if any) where flocculant is added and water is recovered for reuse.

The following examples are set forth for purposes of illustration only and are not to be construed as limitations on the present invention except as set forth in the appended claims. All parts and percentages are by weight unless otherwise specified.

The ore used in the Examples below is from Lang Bay, British Columbia. It contains about 2% coal, which in turn contains a high concentration of germanium. The ore contains an average of 70 ppm germanium.

EXAMPLE 1

650 gm of germanium (Ge) ore (dry ground to −28 mesh) is wet screened through a 400 mesh screen. The +400 mesh fraction (470 gm) is mixed with water to a total of 2.2 liters and the mixture is conditioned in an Agitaire cell with 220 mg (0.47 kg/MT) of a 20/80 wt. % mixture of tall oil pitch (avg. mw. ca. 1000) and #2 fuel oil for 5 minutes. 36 μl of frother (2-ethyl hexanol) is added, and the mixture is floated for 8 minutes. The dried concentrate, tailings, and fines (−400 mesh) are analyzed spectroscopically for Ge, with the result that 71.6% of the Ge is recovered at a grade of 2190 ppm Ge in a concentrate that represents only 2.25 wt. % of the starting ore:

| | Wt. % | ppm Ge | % of Ge |
|---|---|---|---|
| Concentrate | 2.25 | 2190 | 71.6 |
| Tailings | 70.3 | 20 | 20.4 |
| Fines | 27.4 | 20 | 8.0 |

EXAMPLE 2

100 gm of the crushed ore of Example 1 is wet screened through 28 mesh, grinding the larger pieces as necessary until all is −28 mesh. −500 Mesh material is then removed by wet screening. Water is added to the 28×500 mesh material to 1.1 liter, and the mixture is conditioned with 35 mg (0.5 kg/MT) of a 20/80 tall oil fatty acid dimers and trimers (avg. mw. ca. 700) -#2 fuel oil mixture in a Denver cell for 5 minutes. Flotation with 15 μl of a frother (2 ethyl hexanol) then gives the following results:

| | Wt. % | ppm Ge | % of Ge |
|---|---|---|---|
| Concentrate | 13.85 | 1420 | 78.1 |
| Tailings | 67.6 | 10 | 9.7 |
| Fines | 28.6 | 30 | 12.3 |

EXAMPLE 3

40 gm of Ge ore, ground and screened to 28×325 mesh, is mixed with water to 250 ml and conditioned with 40 mg (1.0 kg/MT) of the collector of Example 1 for 10 minutes in a 250 ml glass cell with a fritted disc bottom. Flotation with 10 μl frother (2 ethyl hexanol) gives:

| | Wt. % | ppm Ge | % of Ge |
|---|---|---|---|
| Concentrate | 3.74 | 1750 | 79.5 |
| Tailings | 96.3 | 18 | 20.5 |

Ge in the fines is not measured at the time, but assuming losses in fines similar to above, overall Ge recovery is approximately 70%.

EXAMPLE 4

540 gm Ge ore (dry ground to −28 mesh) is mixed with water to a total of 2.2 liters. This slurry is conditioned with 270 mg (0.50 kg/MT) of the collector of Example 1 for 5 minutes, then floated with 33 μl frother (2 ethyl hexanol).

| | Wt. % | ppm Ge | % of Ge |
|---|---|---|---|
| Concentrate | 3.40 | 1320 | 60.8 |
| Tailings | 96.6 | 30 | 39.2 |

Without desliming (removal of −400 or −500 mesh "fines") prior to flotation, it can be seen that lower recovery of Ge is experienced.

EXAMPLES 5–8

Following the procedure of Example 1, various other collectors are employed in place of the collector set forth therein. In each instance, an excellent separation is achieved. The collectors used are as follows:

(5) 20/70/10 Dymerex[2]/fuel oil/SPF
(6) 30/60/10 PolyPale 2[3]/fuel oil/SPF
(7) 20/80 Hystrene 3680[4]/fuel oil
(8) 20/80 Hystrene 3680[4]/neutral oil[5]

SPF=sulfonated petroleum fraction
2=Hercules Chemical Co. (polymerized tall oil rosin acids—m.w.—500)
3=Hercules Chemical Co. (polymerized tall oil rosin acids—M.W.—500)
4=Humko Chemical Co. (tall oil dimer and trimer acids of 500–800 mol. wt.)
5=Koppers Chemical Co. (crystal free neutral oil from coal tar)

EXAMPLE 9

Again following the procedure of Example 1 except that the collector is a 10/81/9 mixture of the half isobutyl ester of poly(maleic anhydride-octadecene-1)-fuel oil-SPF (see Examples 5–8), excellent separation of the germanium containing coal is achieved.

EXAMPLE 10

The procedure of Example 9 is again followed except that the collector is a 20/72/8 mixture of the half stearyl ester of tetralin dianhydride. Similar results are achieved.

We claim:

1. A process for the recovery of germanium values from ore as a component of carbonaceous material present in minor amounts in said ore which comprises (a) grinding said ore to a particle size of smaller than about −28 mesh,
(b) diluting the resultant ground ore with water to form a slurry,
(c) contacting the resultant slurry with a collector comprising an oil and a carboxylic acid or acidester having a molecular weight of at least about 500 for from about 0.1 to about 30 minutes, with agitation,
(d) adding a frother to the so conditioned slurry,
(e) recovering the carbonaceous component of said ore by froth flotation and
(f) recovering germanium values from said carbonaceous component.

2. A method according to claim 1 wherein the slurry is deslimed before contact with said collector.

3. A method according to claim 1 wherein the pH of the slurry is adjusted to about 5.0 to about 8.0 before contact with said collector.

4. A method according to claim 1 wherein said carbonaceous material is coal.

5. A method according to claim 1 wherein said oil is fuel oil.

6. A method according to claim 1 wherein said acid is a dimer or trimer.

7. A process according to claim 1 or 2 wherein said acid is a rosin acid.

8. A process according to claim 1 or 2 wherein said acid ester is the half isobutyl ester of poly(maleic acid-octadecene-1).

9. A process according to claim 1 or 2 wherein said acidester is the half stearyl ester of tetralin dianhydride.

10. A process according to claim 1 wherein said acid is a tall oil pitch.

11. A process according to claims 1 or 7 wherein said collector contains, in addition, a sulfonated hydrocarbon compound.

* * * * *